US008713976B2

(12) United States Patent
Hoppe et al.

(10) Patent No.: US 8,713,976 B2
(45) Date of Patent: May 6, 2014

(54) SYSTEMS AND METHODS FOR CONTROLLING OPERATION OF A WASHING MACHINE

(75) Inventors: Christopher G. Hoppe, Louisville, KY (US); Ziqiang Hu, Prospect, KY (US)

(73) Assignee: General Electric Company, Schenectady, NY (US)

( * ) Notice: Subject to any disclaimer, the term of this patent is extended or adjusted under 35 U.S.C. 154(b) by 1367 days.

(21) Appl. No.: 11/647,831

(22) Filed: Dec. 29, 2006

(65) Prior Publication Data

US 2008/0155761 A1 Jul. 3, 2008

(51) Int. Cl.
*D06F 29/00* (2006.01)

(52) U.S. Cl.
USPC ..... 68/23.1; 8/159; 68/12.27; 68/12.06; 68/12.04

(58) Field of Classification Search
USPC ..... 8/159; 68/12.04, 12.06, 12.27, 23.1
See application file for complete search history.

(56) References Cited

U.S. PATENT DOCUMENTS

| | | | | |
|---|---|---|---|---|
| 4,368,637 | A * | 1/1983 | Anderson | 73/652 |
| 4,400,838 | A * | 8/1983 | Steers et al. | 8/158 |
| 4,411,664 | A | 10/1983 | Rickard et al. | |
| 5,194,707 | A * | 3/1993 | Wallach | 200/61.45 R |
| 5,255,916 | A * | 10/1993 | Bleich | 273/118 D |
| 5,375,437 | A | 12/1994 | Dausch et al. | |
| 5,396,223 | A * | 3/1995 | Iwabuchi et al. | 340/690 |
| 5,561,993 | A | 10/1996 | Elgersma et al. | |
| 5,768,730 | A * | 6/1998 | Matsumoto et al. | 8/159 |
| 6,065,170 | A * | 5/2000 | Jang | 8/158 |
| 6,087,936 | A * | 7/2000 | Woods | 340/566 |
| 6,422,047 | B1 | 7/2002 | Magilton | |
| 6,460,381 | B1 * | 10/2002 | Yoshida et al. | 68/12.04 |
| 6,510,715 | B1 * | 1/2003 | Simsek | 68/12.06 |
| 6,578,225 | B2 * | 6/2003 | Jonsson | 8/159 |
| 6,594,841 | B2 | 7/2003 | Broker et al. | |
| 6,640,372 | B2 * | 11/2003 | Ciancimino et al. | 8/159 |
| 6,654,975 | B2 | 12/2003 | Broker | |
| 6,742,208 | B2 * | 6/2004 | Broker | 8/158 |
| 6,983,657 | B1 * | 1/2006 | Kakutani et al. | 73/779 |
| 7,039,976 | B2 | 5/2006 | Sears | |
| 7,162,759 | B2 * | 1/2007 | Weinmann | 8/158 |

(Continued)

FOREIGN PATENT DOCUMENTS

| | | | | |
|---|---|---|---|---|
| EP | 0 294 014 | A | 12/1988 | |
| GB | 2269825 | A * | 2/1994 | D06F 39/00 |

*Primary Examiner* — Michael Kornakov
*Assistant Examiner* — Katelyn Whatley
(74) *Attorney, Agent, or Firm* — Global Patent Operation; Douglas D. Zhang

(57) ABSTRACT

A control system is provided for a washing machine including a cabinet, a wash tub positioned within the cabinet and a wash basket rotatably mounted within the wash tub. The control system includes a plurality of supports including two diagonally arranged supports. The plurality of supports are configured to support the washing machine on a surface. At least one load sensor is positioned with respect to each support of the two diagonally arranged supports. The at least one load sensor is configured to detect at least one force component applied to each support by a load within the wash basket. The at least one load sensor is further configured to generate a signal representative of the at least one force component. A controller is in signal communication with the at least one load sensor. The controller is configured to detect an operating load placement condition within the wash basket in response to at least one signal received from the at least one load sensor.

15 Claims, 2 Drawing Sheets

(56) References Cited

U.S. PATENT DOCUMENTS

| | | | | |
|---|---|---|---|---|
| 7,177,712 | B2 | 2/2007 | Blair et al. | |
| 7,676,874 | B2 * | 3/2010 | Cho | 8/158 |
| 2002/0095269 | A1 * | 7/2002 | Natalini et al. | 702/188 |
| 2002/0194682 | A1 * | 12/2002 | Conrath | 8/159 |
| 2005/0251926 | A1 * | 11/2005 | Lee et al. | 8/158 |
| 2005/0283919 | A1 * | 12/2005 | Kim | 8/158 |
| 2006/0042328 | A1 * | 3/2006 | Komatsu et al. | 68/12.06 |
| 2006/0053839 | A1 * | 3/2006 | Matsushima et al. | 68/3 R |
| 2006/0075791 | A1 * | 4/2006 | Seo et al. | 68/23.1 |
| 2006/0191301 | A1 * | 8/2006 | Park et al. | 68/140 |
| 2007/0039359 | A1 * | 2/2007 | Lee et al. | 68/23.1 |
| 2007/0068032 | A1 * | 3/2007 | Bringewatt et al. | 34/318 |

* cited by examiner

SYSTEMS AND METHODS FOR CONTROLLING OPERATION OF A WASHING MACHINE

BACKGROUND OF THE INVENTION

This invention relates generally to washing machines and, more particularly, to methods and apparatus for detecting a load placement condition within washing machines.

Conventional clothes treating apparatus, such as washing machines and drying machines, include a cabinet that houses a tub for containing a quantity of water and/or cleaning fluid, and a perforated basket positioned within the tub configured to receive a load of articles for cleaning, such as clothes and/or household fabrics. A drive and motor assembly is mounted within the cabinet for rotating the basket within the tub. A pump assembly pumps water from the tub to a drain during a cleaning cycle.

Unbalanced load placement conditions may occur within the wash basket during a cleaning cycle. The unbalanced load within the basket may result in undesirable vibration and/or noise. At least one conventional clothes treating apparatus performs a correction process upon detecting the unbalanced load placement condition. However, such correction processes may not effectively reduce or eliminate an unbalanced load situation without detecting a weight and/or a placement or location of the unbalanced load.

BRIEF DESCRIPTION OF THE INVENTION

In one aspect, a control system for a washing machine is provided. The washing machine includes a cabinet, a wash tub positioned within the cabinet and a wash basket rotatably mounted within the wash tub. The control system includes a plurality of supports including two diagonally arranged supports. The plurality of supports are configured to support the washing machine on a surface. At least one load sensor is positioned with respect to each support of the two diagonally arranged supports. The at least one load sensor is configured to detect at least one force component applied to each support by a load within the wash basket. The at least one load sensor is further configured to generate a signal representative of the at least one force component. A controller is in signal communication with the at least one load sensor. The controller is configured to detect an operating load placement condition within the wash basket in response to at least one signal received from the at least one load sensor.

In another aspect, a washing machine is provided. The washing machine includes a cabinet, a wash tub positioned within the cabinet, and a wash basket rotatably mounted within the wash tub. A plurality of supports including two diagonally arranged supports are configured to support the washing machine on a surface. A plurality of load sensors are positioned within each support of the two diagonally arranged supports. Each load sensor of the plurality of load sensors is configured to detect at least one component of a force applied to the corresponding support by a load within the wash basket. Each load sensor is further configured to generate a signal representative of the at least one component. A controller is in signal communication with the plurality of load sensors. The controller is configured to confirm a load placement condition within the wash basket based at least partially on the signal received from each load sensor.

In still another aspect, a method for operating a washing machine is provided. The method includes providing a cabinet including a wash tub positioned within the cabinet, a wash basket rotatably mounted within the wash tub, and a plurality of supports configured to support the washing machine on a surface. A plurality of load sensors are operatively coupled to each of two diagonally arranged supports of the plurality of supports. Each load sensor is configured to detect at least one component of a force applied to the corresponding support by a load within the wash basket. Each load sensor is further configured to generate a signal representative of the at least one component. A controller is coupled in signal communication with the plurality of load sensors. The controller is configured to detect an operating load placement condition within the wash basket based at least partially on at least one signal received from the plurality of load sensors.

DETAILED DESCRIPTION OF THE INVENTION

Figure 1:
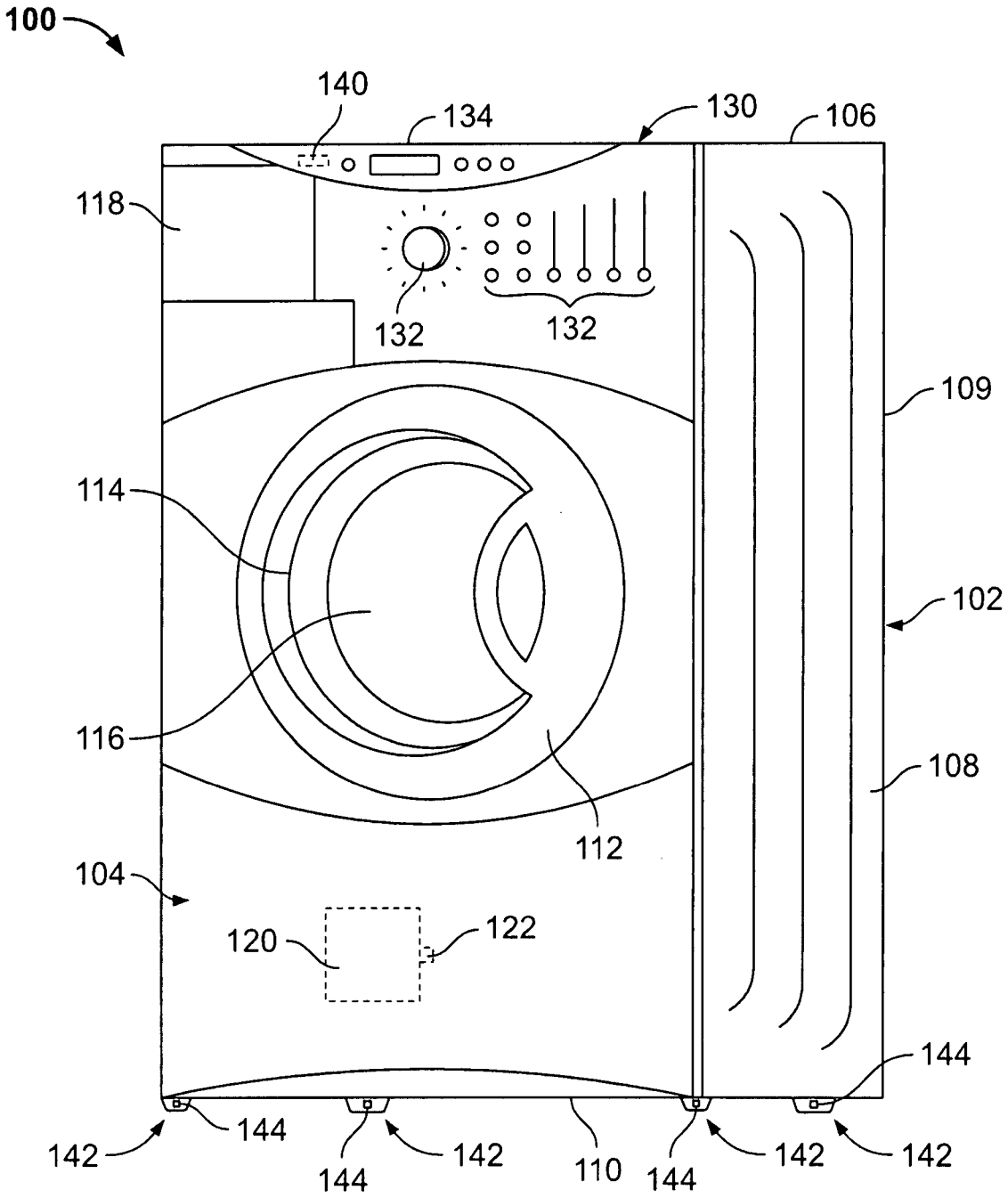
FIG. 1 is a perspective view of an exemplary washing machine.

FIG. 1 is a perspective view of an exemplary washing machine 100. Washing machine 100 includes a cabinet 102 having a front panel 104, a top panel 106, opposing side panels 108, a rear panel 109, and a bottom panel 110. As shown in FIG. 1, washing machine 100 is a horizontal axis washing machine 100. It should be apparent to those skilled in the art and guided by the teachings herein provided that the control system and methods as described herein are suitable for use with other washing machines and/or household or industrial appliances, such as vertical axis washing machines and/or drying machines.

In the exemplary embodiment, a door 112 is hingedly by mounted to front panel 104 and is pivotally movable between an open position and a closed position, as shown in FIG. 1, forming a substantially sealed enclosure. A wash tub 114 is positioned within cabinet 102 and a wash basket 116 is rotatably mounted within wash tub 114. Wash basket 116 is configured to hold washable articles, such as clothes and/or household fabrics, to facilitate washing the articles. A dispenser 118 is mounted on front panel 104 for adding washing detergent into wash tub 114. A motor 120 is positioned within cabinet 102. Motor 120 is drivingly coupled to wash basket 116 to drive wash basket 116 to rotate around a substantially horizontal axis. In one embodiment, motor sensor 122 is positioned with respect to motor 120 for detecting an operational status of motor 120. Any suitable motor sensor 122 known to those skilled in the art and guided by the teachings herein provided may be used in cooperation with motor 120 to detect the operational status of motor 120.

A control panel 130 is coupled to an upper portion of front panel 104. Control panel 130 includes a plurality of input selectors 132 and/or a display 134. Input selectors 132 and display 134 collectively form a control interface for user selection of operation cycles and/or operation features. Display 134 indicates selected operation cycles and/or operation features and/or other items of interest to the user. A controller 140 is mounted on control panel 130 and is in operational control communication with input selectors 132 and/or display 134 for receiving and/or displaying user selection of operation cycles and/or operation features.

In the exemplary embodiment, washing machine 100 includes at least one support, such as four supports 142 coupled to bottom panel 110 as shown in FIG. 1, for supporting washing machine 100 on a support surface, such as a building floor. At least one load sensor, such as at least one load cell 144, is positioned with respect to a corresponding support 142 for detecting at least one component of a force applied to corresponding support 142. In the exemplary embodiment, a plurality of load cells 144, such as two load cells 144, are positioned on or within each of two diagonally arranged supports 142. In a further exemplary embodiment, load cells 144 are positioned on or within each support 142. In an alternative embodiment, a plurality of load cells 144, such as four load cells 144, are positioned within each of two diagonally arranged supports 142 or within each support 142 for detecting a weight applied to corresponding support 142. It should be apparent to those skilled in the art and guided by the teachings herein provided that any suitable number of supports 142 and/or any suitable number of load cells 144 may be utilized in alternative embodiments. Further, support 142 and/or load cell 144 may be suitably positioned with respect to washing machine 100 in alternative embodiments.

Figure 2:
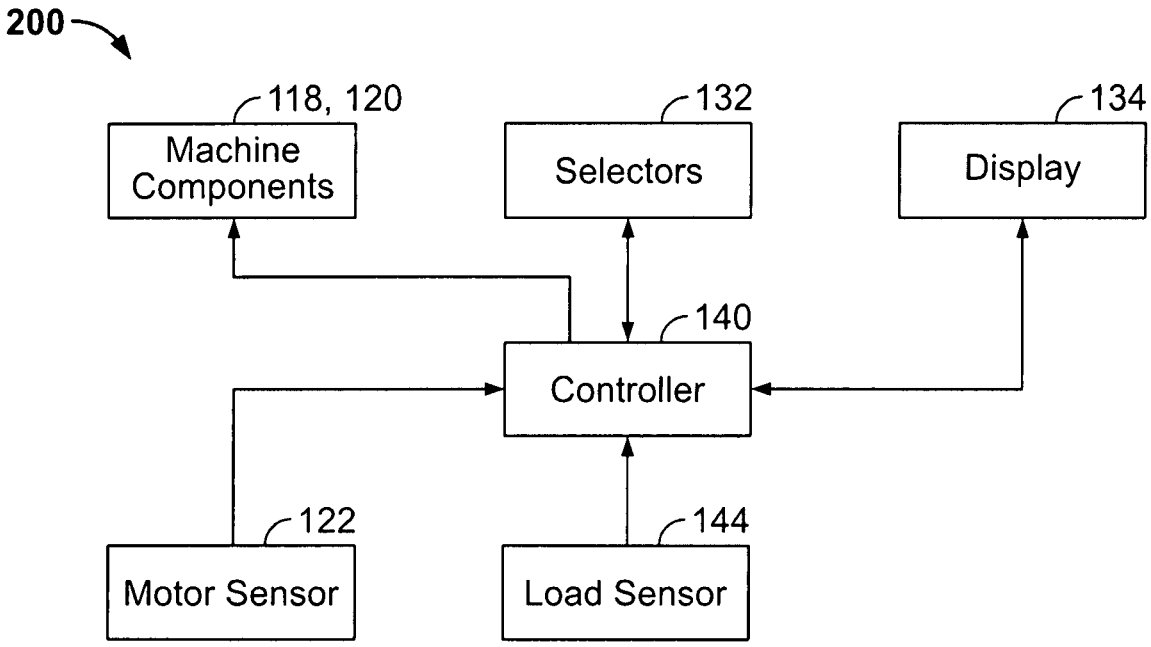
FIG. 2 is a schematic view of an exemplary control system suitable for use with the washing machine shown in FIG. 1.

FIG. 2 is a schematic view of a control system 200 suitable for use in cooperation with washing machine 100 shown in FIG. 1. Controller 140 is operatively coupled to input selectors 132 and/or display 134 for receiving from and/or transmitting to input selectors 132 and/or display 134 operational control signals. Controller 140 is in independent signal communication with motor sensor 122 and/or load cell 144 for receiving a detected operational status. Controller 140 is further in control communication with dispenser 118, motor 120, and/or other machine components (not shown) to facilitate executing operation cycles and/or features, as described in greater detail below.

In an exemplary operating cycle, a load within wash basket 116 generates a force when wash basket 116 rotates during the wash cycle. The force is transmitted to supports 142, as shown in FIG. 1, and into the building floor, which supports washing machine 100. Load cells 144 detect the force applied to corresponding supports 142, and generate a signal representative of the detected force. Controller 140 then determines an operating load placement condition within wash basket 116 in response to the signal(s) received from load cells 144.

In one embodiment, diagonally opposing pairs of load cells 144 on or within supports 142 form a cooperating pair of load cells 144. Controller 140 processes signals received from each cooperating group of load cells 144 to facilitate determining a load placement condition. In an alternative embodiment, only two cooperating load cells 144 are diagonally arranged on bottom panel 110 to provide an input for determining the load placement condition.

In one embodiment, controller 140 confirms a balanced load placement condition or an unbalanced load placement condition within wash basket 116 in response to the signals received from load cells 144. The force pattern distributed to supports 142 corresponds to a weight and/or a position or location of the load within wash basket 116. As such, controller 140 determines the weight and/or the location of the load within wash basket 116 in response to the signals received from at least one cooperating group of load cells 144.

When an unbalanced load placement condition is detected and/or confirmed, controller 140 determines a status of the unbalanced condition including, without limitation, a weight of the unbalanced load and/or a location of the unbalanced load, such as in a front portion, middle portion or rear portion of wash basket 116. In one embodiment, controller 140 determines the weight of the unbalanced load based at least partially on a peak force detected by load cells 144. In a further embodiment, controller 140 also determines the location of the unbalanced load based on the force distribution pattern detected by load cells 144.

In a further embodiment, motor sensor 122 detects an operational status including, without limitation, torque, voltage, current fluctuation and/or phase angles of motor 120. The signal received from motor sensor 122 is combined with the signals received from load cells 144 to determine the total weight of the load and/or the weight and/or the location of the unbalanced load.

In one embodiment, controller 140 initiates a correction process upon detecting and/or confirming the unbalanced load placement condition. In a further embodiment, controller 140 operates the correction process based on at least one of the total weight of the load, and the weight and/or the location of the unbalanced load. In this embodiment, controller 140 operates a predetermined basket tumbling process and/or a water removal process to minimize or eliminate the unbalanced load condition. Controller 140 also controls the wash pattern, the rotational speed and/or the acceleration of wash basket 116 based on the signals received from load cell 144 and/or motor sensor 122.

In one embodiment, controller 140 receives an environmental parameter inputted or selected by the user through input selectors 132 and/or display 134. The user inputs or selects a floor condition, a noise requirement and/or any suitable environmental condition into controller 140. In a particular embodiment, controller 140 sets a scale parameter according to the inputted or selected environmental parameter. Controller 140 then scales the force detected by load cells 144 according to the scale parameter and operates washing machine 100 based on the scaled force. As such, the vibration and/or the noise of washing machine 100 may be controlled at different levels according to the environmental parameter. In an alternative embodiment, the user inputs or selects a maximum force level for supports 142 through input selectors 132 and/or display 134. Controller 140 then maintains the force detected by load cells 144 below the inputted or selected force level during operation of washing machine 100. As such, the vibration and/or noise of washing machine 100 is reduced or eliminated when washing machine 100 is supported on a weak support surface.

In one embodiment, the controller determines the load placement condition within the wash basket in response to signals received from the load sensors. In a further embodiment, the controller detects the weight and/or the location of the unbalanced load to facilitate performing a correction process to reduce the vibration and/or the noise caused by the unbalanced load. Additionally, the user may input an environment parameter to facilitate controlling and maintaining the vibration and/or the noise below a selected threshold level during operation of the washing machine.

While the invention has been described in terms of various specific embodiments, those skilled in the art will recognize that the invention can be practiced with modification within the spirit and scope of the claims.

What is claimed is:

1. A control system for a washing machine including a motor, a cabinet, a wash tub positioned within the cabinet and a wash basket rotatably mounted within the wash tub, said control system comprising:

a plurality of supports comprising two diagonally arranged supports, said plurality of supports configured to support the washing machine on a surface;

at least one load sensor positioned with respect to each support of said two diagonally arranged supports, said at least one load sensor configured to detect a level of force applied to a corresponding support by a load within the wash basket, said at least one load sensor further configured to generate a signal representative of the detected level of force;

an input device that enables a user to select a force level threshold and a noise level threshold for a selected operation of the washing machine, and a condition of the surface; and a controller in signal communication with said input device and said at least one load sensor positioned with respect to each support, said controller being configured to detect an operating load placement condition within the wash basket in response to at least one signal received from said at least one load sensor positioned with respect to each support, said controller further configured to detect a weight and a location of the load within the wash basket in response to the signal received from said at least one load sensor positioned with respect each support, said controller being further configured to maintain a force applied on each of the plurality of supports below the force level threshold selected by the user, and operate a correction process upon detection of an unbalanced load placement condition based at least in part on the condition of the surface, wherein the controller is further configured to maintain a noise level for the selected operation of the washing machine below the noise level threshold selected by the user and operate the correction process to reduce the noise level for the selected operation of the washing machine based on the condition of the surface and the level of force detected by the at least one load sensor.

2. A control system in accordance with claim 1 wherein said controller is further configured to confirm one of a balanced load placement condition and the unbalanced load placement condition within the wash basket.

3. A control system in accordance with claim 2 wherein said controller is further configured to operate the correction process in response to a confirmation of the unbalanced load placement condition.

4. A control system in accordance with claim 1 wherein said at least one load sensor positioned with respect to each support further comprises at least one load cell configured to detect a weight applied thereon.

5. A washing machine comprising:

a cabinet;

a motor;

a wash tub positioned within said cabinet;

a wash basket rotatably mounted within said wash tub;

a plurality of supports comprising two diagonally arranged supports, said plurality of supports configured to support said washing machine on a surface;

a plurality of load sensors associated with each support of said two diagonally arranged supports, each load sensor of said plurality of load sensors configured to detect a level of force applied to a corresponding support by a load within said wash basket, each load sensor further configured to generate a signal representative of the detected level of force;

an input device that enables a user to select a force level threshold and a noise level threshold for a selected operation of the washing machine and a condition of the surface; and a controller in signal communication with said input device and said plurality of load sensors, said controller being configured to confirm a load placement condition within said wash basket based at least partially on the signal received from each load sensor, said controller being further configured to detect a weight and a location of the load within said wash basket in response to the signal received from each of said plurality of load sensors, said controller further configured to maintain a force applied on each of the plurality of supports below the force level threshold selected by the user and operate a correction process upon detection of an unbalanced load placement condition based at least in part on the condition of the surface, wherein the controller is further configured to maintain a noise level for the selected operation of the washing machine below the noise level threshold selected by the user and operate the correction process to reduce the noise level for the selected operation of the washing machine based on the condition of the surface and the level of force detected by the at least one load sensor.

6. A washing machine in accordance with claim 5 wherein said controller is configured to detect one of a balanced load placement condition and the unbalanced load placement condition in response to the signal received from each load sensor.

7. A washing machine in accordance with claim 5 wherein said controller is configured to operate said washing machine at least partially based on detection of one of a balanced load placement condition and the unbalanced load placement condition.

8. A washing machine in accordance with claim 5 wherein said controller is further configured to activate the correction process upon detection of the unbalanced load placement condition.

9. A washing machine in accordance with claim 8 wherein said correction process includes at least one of adjusting a rotational speed of the wash basket, an acceleration of the wash basket, and a wash pattern.

10. A method of operating a washing machine comprising a motor, the method comprising:

providing a cabinet including a wash tub positioned within the cabinet, a wash basket rotatably mounted within the wash tub, and a plurality of supports configured to support the washing machine on a surface operatively coupling a plurality of load sensors to each of two diagonally arranged supports of the plurality of supports, each load sensor of the plurality of load sensors configured to detect a level of force applied to a corresponding support by a load within the wash basket, each load sensor further configured to generate a signal representative of the detected level of force;

providing an input device that enables a user to select a force level threshold and a noise level threshold for a selected operation of the washing machine and a condition of the surface; and coupling a controller in signal communication with the plurality of load sensors and the input device, the controller being configured to detect an operating load placement condition within the wash basket based at least partially on at least one signal received from the plurality of load sensors, the controller being further configured to detect a weight and a location of the load within the wash basket in response to the signal received from each of the plurality of load sensors, the controller being further configured to maintain a force applied on each of the plurality of supports below the force level threshold selected by the user and operate a correction process upon detection of an unbalanced load placement condition based at least in part on the condition of the surface, wherein the controller is further configured to maintain a noise level for the selected operation of the washing machine below the noise level threshold selected by the user and operate the correction process to reduce the noise level for the selected operation of the washing machine based on the condition of the surface and the level of force detected by at least one of the plurality of load sensors.

11. A method in accordance with claim 10 further comprising detecting one of a balanced load placement condition and the unbalanced load placement condition based on a signal received from each of the plurality of load sensors.

12. A method in accordance with claim 11 wherein maintaining a force applied on each of the plurality of supports below the force level threshold comprises operating the correction process upon detection of the unbalanced load placement condition.

13. A control system in accordance with claim 1, wherein the input device is a display configured to receive and display user selection of operation cycles and/or operation features of the washing machine.

14. A control system in accordance with claim 1, wherein operating the correction process to reduce the noise level of the operation of the washing machine comprises at least one of balancing an unbalanced load, adjusting a rotational speed of the wash basket, adjusting an acceleration of the wash basket, and adjusting a wash pattern.

15. A control system in accordance with claim 1, further comprising a motor sensor configured to detect a status of the motor, said motor sensor further configured to generate a signal representative of the status of the motor; and wherein operating the correction process upon detection of the unbalanced load placement condition is based at least in part on the status of the motor.

* * * * *

UNITED STATES PATENT AND TRADEMARK OFFICE

CERTIFICATE OF CORRECTION

PATENT NO. : 8,713,976 B2
APPLICATION NO. : 11/647831
DATED : May 6, 2014
INVENTOR(S) : Hoppe et al.

It is certified that error appears in the above-identified patent and that said Letters Patent is hereby corrected as shown below:

In the claims

In Column 5, Line 17, in Claim 1, delete “respect each” and insert -- respect to each --, therefor.

Signed and Sealed this
First Day of December, 2015

Michelle K. Lee

Michelle K. Lee
*Director of the United States Patent and Trademark Office*